US007128699B2

(12) United States Patent
Hsu

(10) Patent No.: US 7,128,699 B2
(45) Date of Patent: Oct. 31, 2006

(54) MULTI-FUNCTIONAL LEG STRETCHING APPARATUS

(75) Inventor: I Lung Hsu, Taichung (TW)

(73) Assignee: Chililon Enterprise Co., Ltd., Taichuang County (TW)

( * ) Notice: Subject to any disclaimer, the term of this patent is extended or adjusted under 35 U.S.C. 154(b) by 66 days.

(21) Appl. No.: 11/062,812

(22) Filed: Feb. 23, 2005

(65) Prior Publication Data

US 2006/0189459 A1 Aug. 24, 2006

(51) Int. Cl.
*A63B 21/055* (2006.01)
*A63B 23/04* (2006.01)

(52) U.S. Cl. ..... 482/125; 482/79; 482/126

(58) Field of Classification Search ..... 482/72, 482/79, 92, 121–126, 130, 140, 145
See application file for complete search history.

(56) References Cited

U.S. PATENT DOCUMENTS 1,706,654 A * 3/1929 Christesen ..... 482/125
1,980,861 A * 11/1934 Hunter ..... 482/125
4,376,533 A * 3/1983 Kolbel ..... 482/125
4,591,150 A * 5/1986 Mosher ..... 482/125
4,909,505 A * 3/1990 Tee ..... 482/129
5,137,503 A * 8/1992 Yeh ..... 482/125
5,318,494 A * 6/1994 Santighian ..... 482/125
5,569,135 A * 10/1996 Chen ..... 482/125
5,674,163 A * 10/1997 Sennett ..... 482/125
5,954,622 A * 9/1999 Olschansky et al. ..... 482/123
2006/0019806 A1* 1/2006 Mikulski ..... 482/121

* cited by examiner

*Primary Examiner*—Jerome Donnelly
*Assistant Examiner*—Victor K. Hwang
(74) *Attorney, Agent, or Firm*—Troxell Law Office, PLLC

(57) ABSTRACT

A multi-functional leg stretching apparatus comprises an anchoring device made up of a positioning seat and a retaining block for the winding around of an elastic strap there-through, a fixed inner tube securely mounted at the anchoring device therein with both ends thereof symmetrically protruding outwards at both sides of the anchoring device, and a pair of movable outer tubes that, each having a pedal, and plate-like protective frame with an embedded support plate mounted thereto, are symmetrically joined to both ends of the fixed inner tube thereof. A resilient member is accommodated inside the fixed inner tube to extend outwards at both ends into which an abutting element is respectively adapted to abut against the adjacent outer edge of the movable outer tube thereby, permitting the abutting elements affected by the bounding force of the resilient member to flexibly draw and limit both movable outer tubes gathering towards the positioning seat of the anchoring device thereby. Therefore, via the aforementioned structure thereof, the stretching apparatus can not only stretch both arms and legs of a user in a straight direction, but can also strengthen the exercise of legs in an alternative transverse direction so as to train muscles of different parts for body-building thereof.

9 Claims, 5 Drawing Sheets

MULTI-FUNCTIONAL LEG STRETCHING APPARATUS

BACKGROUND OF THE INVENTION

The present invention is related to a multi-functional leg stretching apparatus, including an anchoring device for the winding around of an elastic strap having a handle grip attached at the ends thereof, and a pair of pedals with curved plate-like protective frames joined at the upper side thereof to be mounted to a pair of movable outer tubes of the anchoring device; whereby, in addition to stretching legs of a user in a straight direction, the stretching apparatus, equipped with a resilient member, support plates, fixing caps in linkage actuation with the movable outer tubes sliding along a fixed inner tube located at the anchoring device thereof, can also strengthen the exercise of legs in an alternative transverse direction so as to train the muscles of different parts for bodybuilding. Besides, the bottom surfaces of the pedals are slightly higher than that of the anchoring device to avoid interference by the friction with the ground so that the stretching apparatus can be universally and smoothly operated in different positions like sitting on ground/chair, or standing upright, efficiently achieving the best using status and boosting its function thereof.

Please refer to FIG. 1. A conventional rowing-type stretching apparatus 10 is made up of a support rod 11, an elastic strap 12 of rubber material wound around the middle section of the support rod 11, and a handle grip 121 attached at the upper ends of the tied up elastic strap 12 thereof. A pair of block-like pedals 13 each having anti-slippery ribs 131 protruding at the surface thereon is mounted at both ends of the support rod 11 thereof, and a plate-like and flexible frame is curved upwards from both lateral sides of each pedal 13 to define a retaining groove 132 thereby. The pedals 13 are fixedly riveted to the support rod 11 for location thereby.

In operation thereof, a user is seated on a mattress or a chair with both legs resting in a straight or sitting position, and both feet of the user are put into the retaining grooves 132 to step onto the pedals 13 thereof respectively. Then, both hands of the user, holding onto the handle grip 121 thereof, are applied to pull at the elastic strap 22, permitting both feet stretching straight to abut against the pedals 26 with a supporting force in counter to the flexible bounding force of the elastic strap 22 drawn by both arms of the user. Therefore, the elastic strap 12 is repeatedly pulled and rebounded to and fro in the stretching exercise of both arms and legs.

However, there are some drawbacks to such conventional stretching apparatus. Most of all, said conventional stretching apparatus is one-dimensionally made for simple stretching operation thereof. Both hands are applied to pull at the elastic strap 12 in the to-and-fro stretching exercise thereof, while both feet can only stretch straight to abut against the pedals 13 without any other exercise involved in strengthening both legs for which other bodybuilding equipment must be adapted additionally. Thus, the conventional stretching apparatus 10, unable to synchronically exercise and train the stamina of both arms and legs, is reduced in its function thereof.

SUMMARY OF THE PRESENT INVENTION

It is, therefore, the primary purpose of the present invention to provide a multi-functional leg stretching apparatus wherein, in addition to stretching both arms and legs of a user in a straight direction, the stretching apparatus, via a resilient member, support plates, fixing caps in linkage actuation with movable outer tubes sliding along a fixed inner tube located at an anchoring device, can also strengthen the exercise of legs in an alternative transverse direction so as to train the muscles of different parts for bodybuilding thereof.

It is, therefore, the second purpose of the present invention to provide a multi-functional leg stretching apparatus wherein the stretching apparatus is equipped with pedals having bottom surfaces slightly higher than that of an anchoring device so that, when the anchoring device is levelly placed on the ground, the pedals can still be smoothly pushed outwards to stretch a resilient member therewith in strengthening the exercise of the legs without being interfered by the friction with the ground, providing a stretching apparatus that can be universally and smoothly operated in different positions like sitting on ground/chair, or standing upright to achieve the best using status and boost its function thereof.

DETAILED DESCRIPTION OF THE PREFERRED EMBODIMENTS

Figure 1:
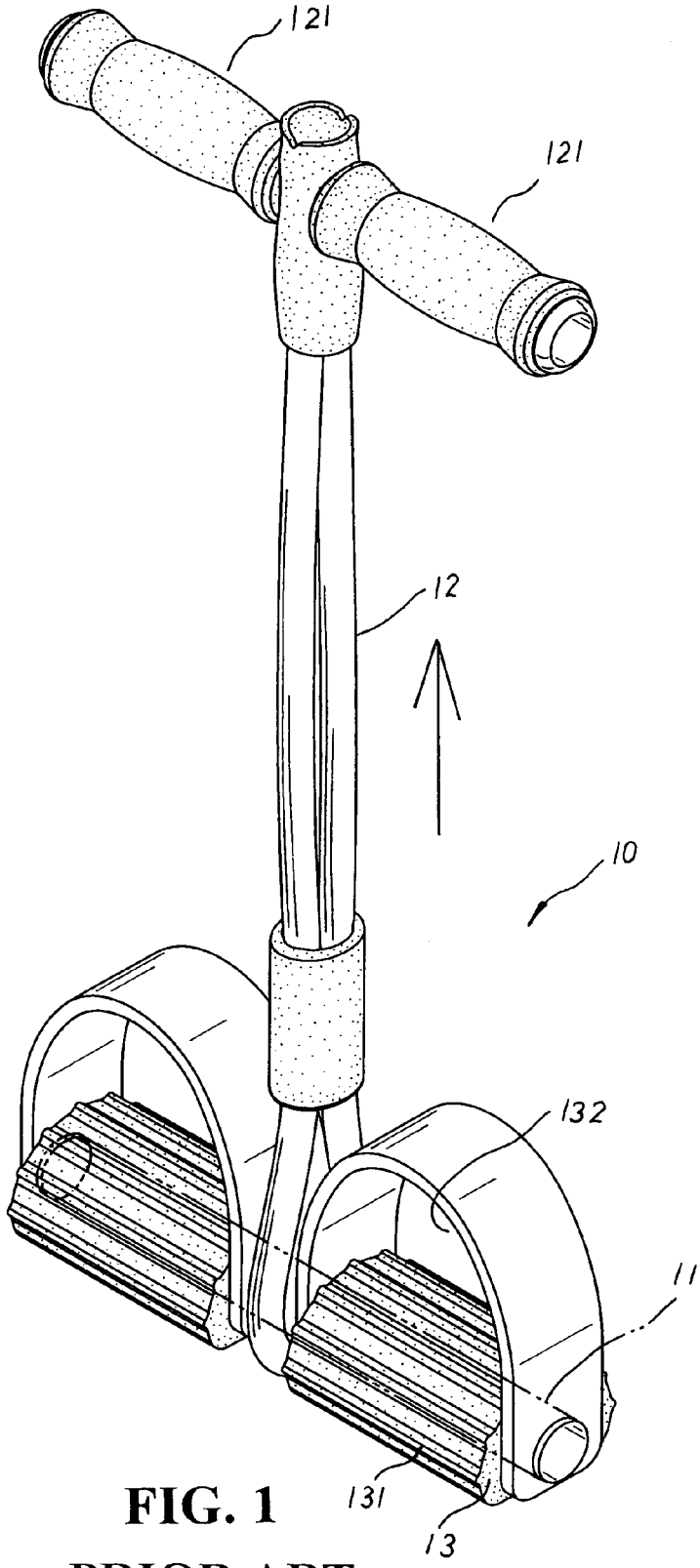
FIG. 1 PRIOR ART
FIG. 1 is a perspective view of a conventional stretching apparatus in operation.
Figure 2:
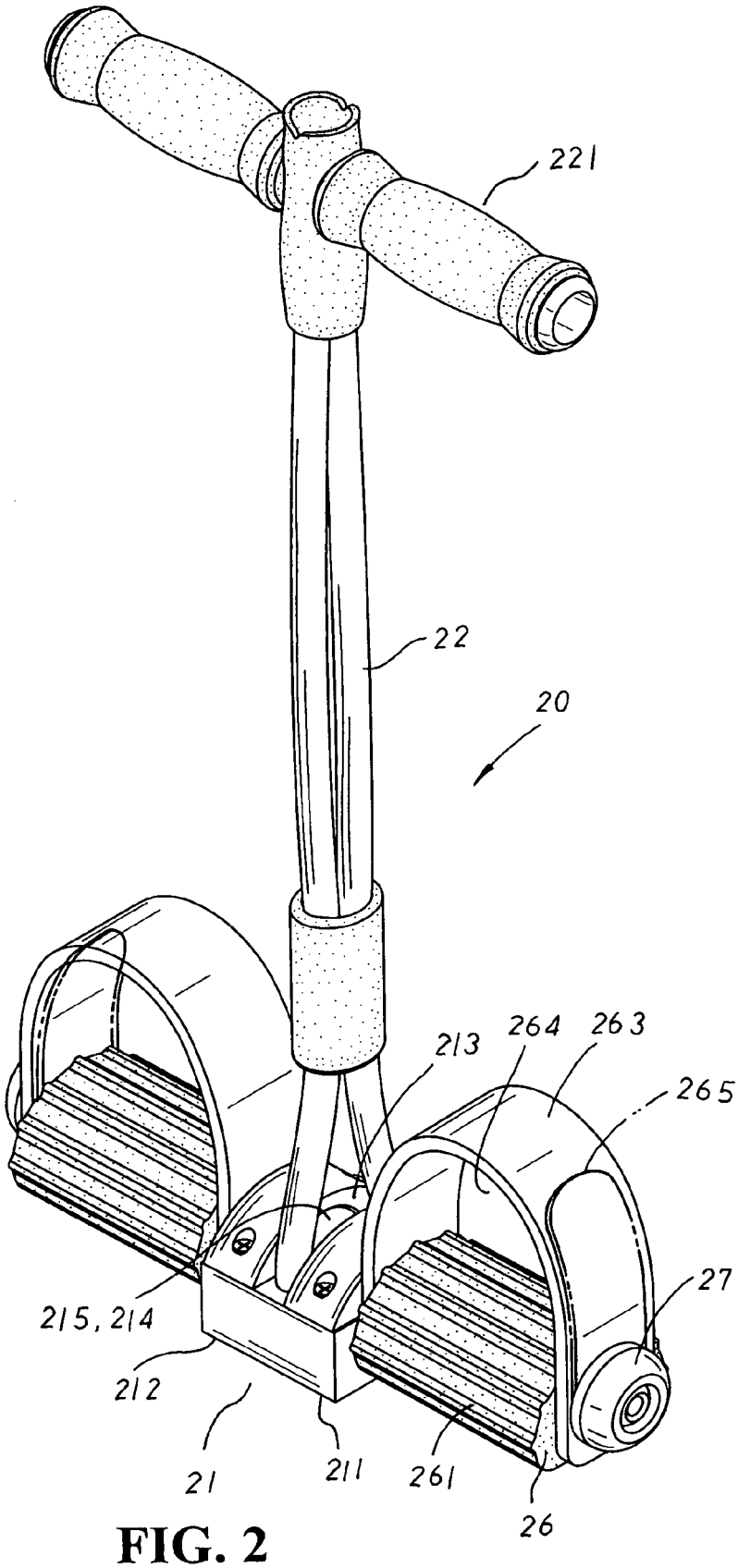
FIG. 2 is a perspective view of the present invention.
Figure 3:
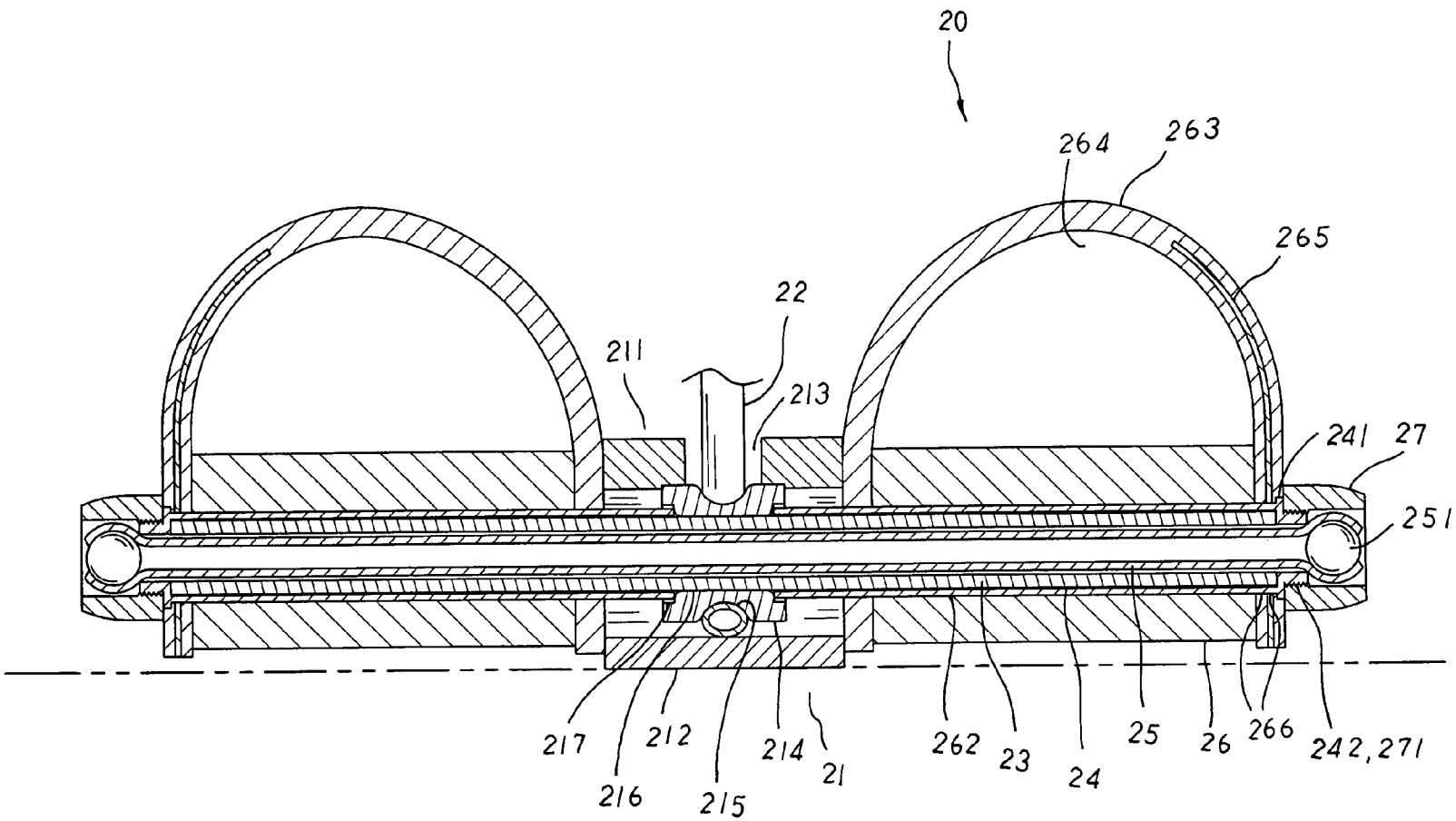
FIG. 3 is a cross sectional view of the present invention in assembly.

Please refer to FIGS. 2 to 3 inclusive. The present invention is related to a multi-functional leg stretching apparatus, including a stretching apparatus 20 equipped with an anchoring device 21 disposed at a proper position thereof wherein the anchoring device 21 is made up of a hollow positioning seat 211 having a flat abutting face 212 disposed at the bottom side thereof and a guide slot 213 opened at the top side thereof in communication with a retaining block 214 that, fixedly located at the interior of the anchoring device 21 therein, has an arcuate concaved groove 215 annularly defining the outer surface thereon to match with the guide slot 213 thereof. Between the retaining block 214 and the bottom inner wall of the positioning seat 211 thereof is revealed a gap for the winding around of an elastic strap 22 of rubber material that is led outwards through the guide slot 213 before tied up and attached to a handle grip 221 at both ends thereof. The retaining block 214 has an inner engaging hole 216 with annular limiting seats 217 defining both ends thereof for a fixed inner tube 23 to securely accommodate therein and extend outwards at both sides of the positioning seat 211 thereof. A pair of movable outer tubes 24 is symmetrically and pivotally mounted at both ends of the fixed inner tube 23. Each movable outer tube 24 is provided with a large-diameter stop flange 241 and a small-diameter locking end 242 sequentially disposed at the outer edge thereof, and the outer diameter of the movable outer tube 24 is correspondingly mated with the inner diameter of the limiting seat 217 thereof. A resilient member 25 of rubber material is accommodated inside the fixed inner tube 23 with both ends thereof extending outwards from the fixed inner tube 23 for an abutting element 251 to be located therein respectively and abutted against the adjacent outer edge of the movable outer tube 24 thereby. Thus, the abutting elements 251 affected by the bounding force of the resilient member 25 can elastically draw and limit both movable outer tubes 24 to correspondingly gather towards the positioning seat 211, permitting a space to form between the stop flanges 241 of the movable outer tubes 24 and the positioning seat 211 for the accommodation of a block-like pedal 26 having anti-slippery ribs 261 distributed at the outer surface thereon and an inner thru-hole 262 disposed therein to be mounted outside the movable outer tubes 24 thereby respectively. A flexible plate-like protective frame 263 is curved upwards from both lateral edges of the pedal 26 with a U-shaped retaining groove 264 formed in the middle thereof, and a support plate 265 is embedded at one side of the plate-like protective frame 263 therein wherein both the support plate 265 and the plate-like protective frame 263 are provided with inserting holes 266 to be engaged with the movable outer tubes 24 thereby. A fixing cap 27 having an internal threaded section 271 is mutually registered with the locking end 242 of the movable outer tube 24 so as to secure tight the pedal 26, the support plate 265, and the plate-like protective frame 263 for location thereby. The abutting element 251 with an outer diameter larger than the inner diameter of the movable outer tube 24 is preferably made of a metallic ball, and the bottom surface of the pedal 26 is slighter higher than the abutting face 212 of the positioning seat 211 thereof.

Figure 4:
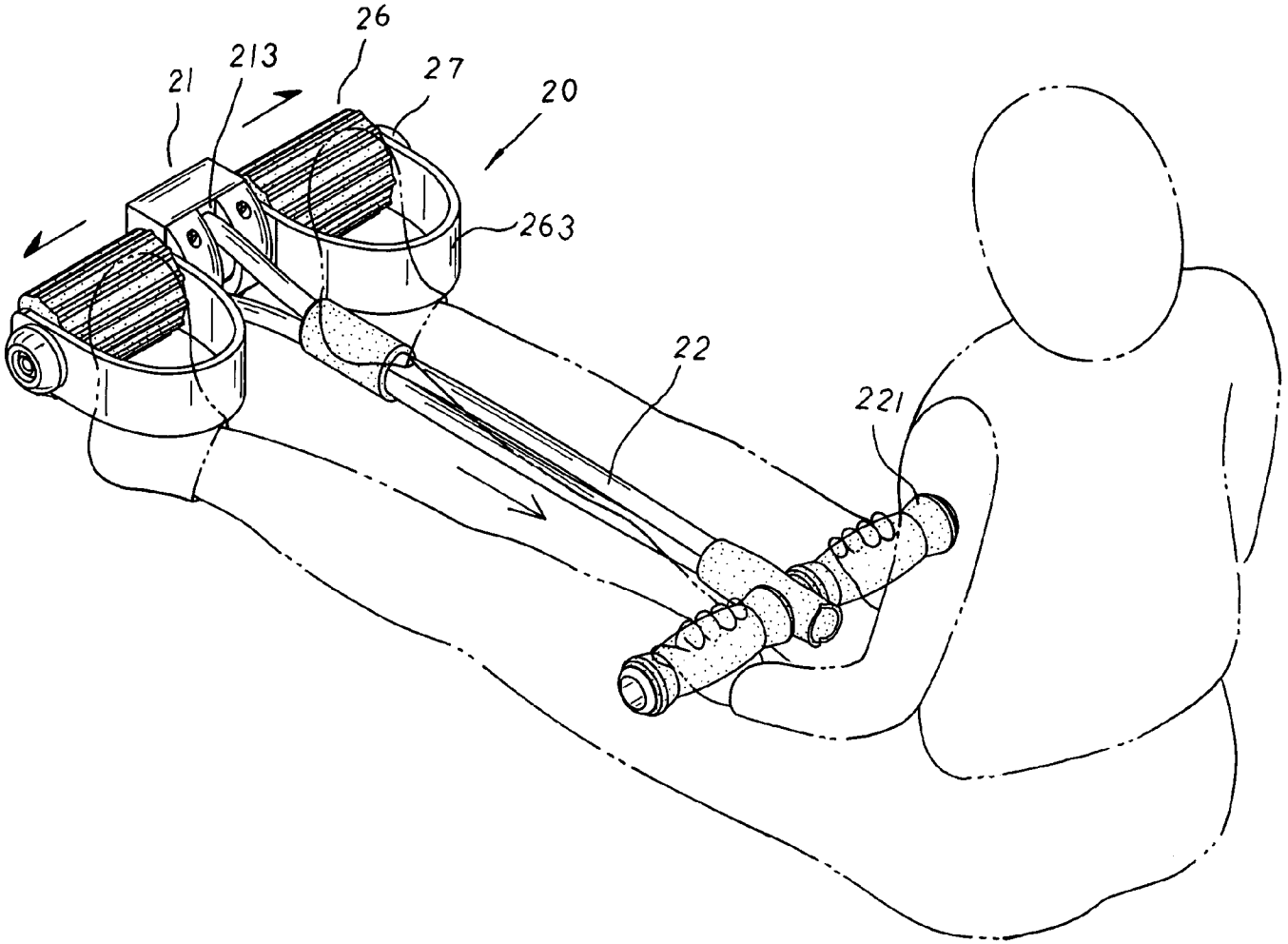
FIG. 4 is a diagram showing an operation of the present invention in practical use.
Figure 5:
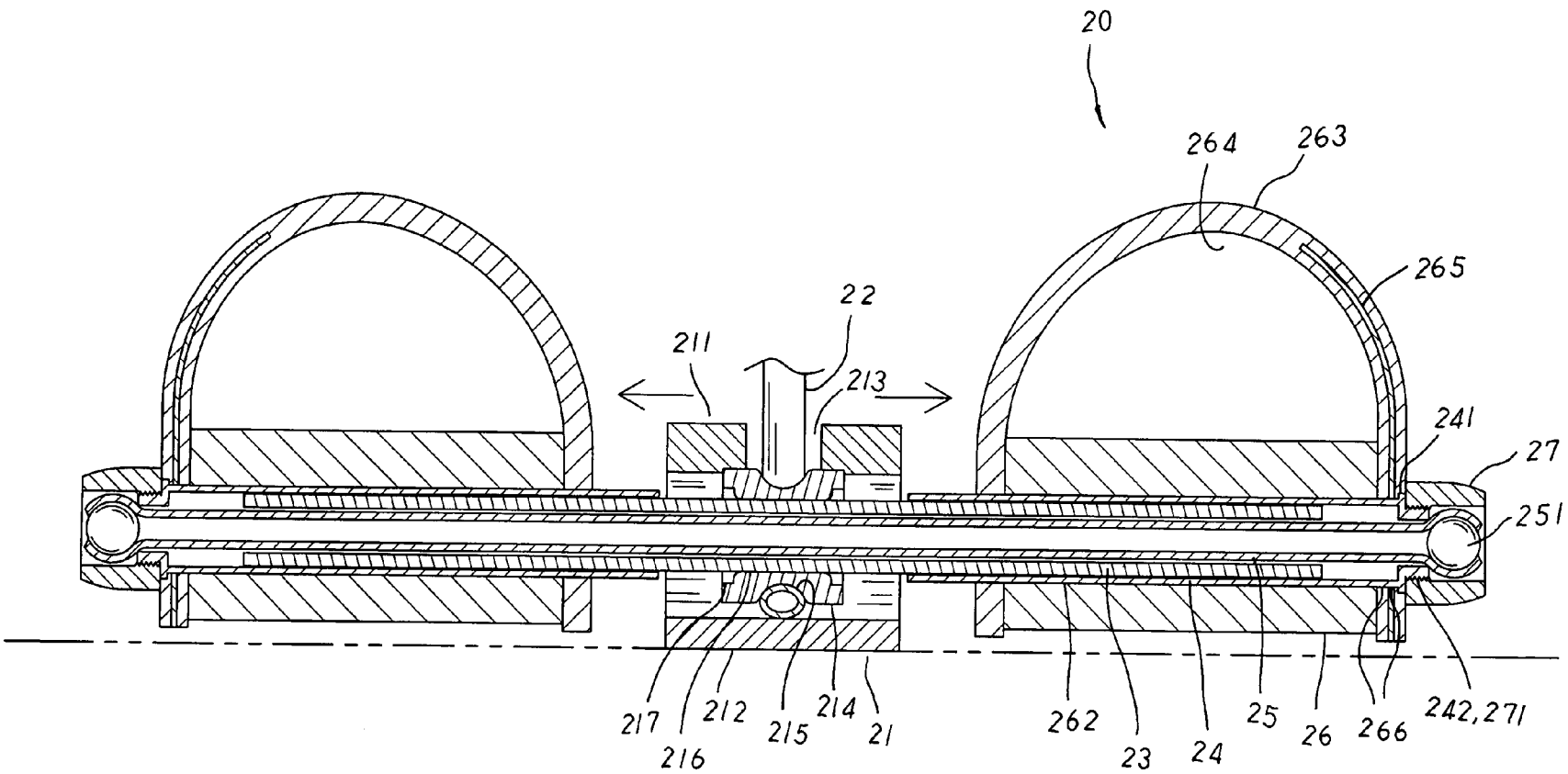
FIG. 5 is a diagram showing another mode of operation of the present invention in practical use.

Please refer to FIG. 4. In operation thereof, a user can be seated on either a mattress or a chair with both legs resting in a straight or sitting position, and both feet of the user are put into the retaining grooves 264 of the stretching apparatus 20 to step onto the pedals 26 thereof respectively. Then, both hands of the user, holding onto the handle grip 221 thereof, are applied to pull at the elastic strap 22, permitting both feet stretching straight to abut against the pedals 26 with a supporting force working in counter to the flexible bounding force of the elastic strap 22 drawn by both arms thereof. Therefore, the elastic strap 22 can be repeatedly pulled and rebound to-and-fro so as to train the stamina of both arms and legs. And to strengthen the exercise of legs, both feet of the user, after the elastic strap 22 is stretched in a fully extended position, are transversely slid along the plate-like protective frames 263, pushing the support plates 265 embedded at the plate-like protective frames 263 therein to move towards the corresponding outer side thereof. Meanwhile, the support plates 265 pushed by the feet thereof will synchronically move outside the fixing caps 27 accordingly, actuating the movable outer tubes 24 and the abutting elements 251 to slide outwards along the fixed inner tube 23 and expand transversely the resilient member 25 therewith. When said transverse stretching force is removed, the resilient member 25 with a rebounding capability will flexibly retract the movable outer tubes 24 along with the fixing caps 27 to move along the fixed inner tube 23 and recover to their former positions with the movable outer tubes 24 precisely abutted against the limiting seats 217 thereof. Therefore, in addition to stretching the legs in a straight direction, the resilient member 25, the support plates 265, the fixing caps 27 and the movable outer tubes 24 in related linkage movement thereof can also strengthen the exercise of legs in an alternative transverse direction so as to effectively train the muscles of different parts for bodybuilding thereof. Besides, the bottom surfaces of the pedals 26 are slightly higher than the abutting face 212 of the positioning seat 211 so that, when the anchoring device 21 is levelly placed on the ground as shown in FIG. 5, the pedals 26 can still be smoothly pushed outwards to expand the resilient member 25 therewith in the stretching exercise of the legs without being interfered by the friction with the ground thereof. Thus, the stretching apparatus 20 can be universally and smoothly operated in different positions like sitting on ground/chair, or standing upright, efficiently achieving the best using status and boosting its function thereof.

What is claimed is:

1. A multi-functional leg stretching apparatus, comprising an elastic strap with a handle grip attached at the ends thereof, and a pair of pedals each having a curved plate-like protective frame with a U-shaped retaining groove mounted at the upper side thereof; the present invention being characterized by that, the stretching apparatus also including an anchoring device disposed at a proper position thereof for the winding around of the elastic strap there-through, and a fixed inner tube securely mounted at the anchoring device therein with both ends thereof symmetrically protruding outwards at both sides of the anchoring device for a pair of movable outer tubes to be symmetrically and pivotally engaged therewith; a resilient member is accommodated inside the fixed inner tube with both ends thereof extending outwards there-from for an abutting element to be respectively adapted thereto and abutted against the adjacent outer edge of the movable outer tube thereby, permitting the abutting elements affected by the bounding force of the resilient member to draw and limit both movable outer tubes gathering towards a positioning seat of the anchoring device, and a space to form between stop flanges of the movable outer tubes and the positioning seat thereof for the block-like pedals to accommodate therein and mount outside the movable outer tubes thereof; besides, the plate-like protective frame thereof has a support plate embedded at one side therein, and a fixing cap having an internal threaded section is mutually registered with a locking end of the movable outer tube respectively so as to secure tight the pedal, the support plate, and the plate-like protective frame for location thereby.

2. The multi-functional leg stretching apparatus as claimed in claim 1 wherein the anchoring device thereof is made up of a hollow positioning seat having a flat abutting face disposed at the bottom side thereof and a guide slot opened at the top side thereof in communication with a retaining block that, fixedly located at the interior of the anchoring device thereof, has an arcuate concaved groove annularly defining the outer surface thereon to match with the guide slot thereof, and between the retaining block and the bottom inner wall of the positioning seat thereof is revealed a gap for the winding around of the elastic strap that is led outwards through the guide slot thereby; the retaining block has an inner engaging hole with annular limiting seats defining both ends thereof for the fixed inner tube to securely mount therein for location thereby.

3. The multi-functional leg stretching apparatus as claimed in claim 1 wherein the movable outer tube thereof has a large-diameter stop flange and a small-diameter locking end sequentially disposed at the outer edge thereof.

4. The multi-functional leg stretching apparatus as claimed in claim 1 wherein the outer diameter of the movable outer tube is matched with the inner diameter of the limiting seat of the retaining block thereof.

5. The multi-functional leg stretching apparatus as claimed in claim 1 wherein the resilient member thereof is preferably made of rubber material.

6. The multi-functional leg stretching apparatus as claimed in claim 1 wherein the support plates and the plate-like protective frames are respectively equipped with inserting holes to be mounted to the movable outer tubes thereby.

7. The multi-functional leg stretching apparatus as claimed in claim 1 wherein the abutting element thereof has an outer diameter larger than the inner diameter of the movable outer tube thereof.

8. The multi-functional leg stretching apparatus as claimed in claim 1 wherein the abutting element thereof is preferably made of a metallic ball.

9. The multi-functional leg stretching apparatus as claimed in claim 1 wherein the bottom surfaces of the pedals are slighter higher than the abutting face of the positioning seat thereof.

* * * * *